United States Patent [19]

Schelfaut et al.

[11] 4,148,647

[45] Apr. 10, 1979

[54] REVERSAL PROCESSING OF EXPOSED LIPPMAN-EMULSIONS

[75] Inventors: François L. Schelfaut, St. Niklaas; Willy J. Vanassche, Kontich; Herman A. Philippaerts; René O. Duville, both of Edegem, all of Belgium

[73] Assignee: AGFA-GEVAERT N.V., Mortsel, Belgium

[21] Appl. No.: 747,338

[22] Filed: Dec. 3, 1976

[30] Foreign Application Priority Data

Dec. 12, 1975 [GB] United Kingdom ..... 51087/75

[51] Int. Cl.[2] ..... G03C 5/50

[52] U.S. Cl. ..... 96/59

[58] Field of Search ..... 96/59

[56] References Cited

U.S. PATENT DOCUMENTS

| | | | |
|---|---|---|---|
| 3,617,282 | 11/1971 | Bard | 96/59 |
| 3,640,717 | 2/1972 | Gallet | 96/59 |
| 3,658,535 | 4/1972 | Willems | 96/59 |
| 3,779,764 | 12/1973 | Moll | 96/59 |
| 3,841,877 | 10/1974 | Willems et al. | 96/59 |

*Primary Examiner*—Mary F. Kelley

*Attorney, Agent, or Firm*—A. W. Breiner

[57] ABSTRACT

A method is described of making reversal images in Lippmann-emulsions wherein the emulsion is image-wise exposed and subjected to a first stage development so that a negative silver image of the original is formed but some silver halide is left in the exposed areas, and then to a second stage development under fogging conditions to develop said residual silver halide in the exposed areas, whereafter the silver developed in said first and second development stages is bleached and the active silver halide then still remaining in the emulsion is converted to form a positive image.

10 Claims, No Drawings

REVERSAL PROCESSING OF EXPOSED LIPPMAN-EMULSIONS

The present invention relates to reversal processing of exposed Lippmann-emulsions.

Lipmann-emulsions, having an average grain-size of less than 0.1 μm (100 nm), are of particular importance for the preparation of photographic plates or films with high resolution, for use in microphotography, for recording nucleophysical phenomenons, for the preparation of masks in the production of microelectronic integrated circuits, for use in holography, for high-density data storage, etc.

In the production of microelectronic integrated circuits, drawings are made on highly enlarged scale of the various successive masks necessary to produce one integrated circuit where-upon the drawings are reduced, if necessary in successive steps, and reproduced on a photographic plate or film material forming thereby the mask ready for use. By various photographic and chemical steps (photo-etching of lacquered plates) the images of the masks thus produced are transferred to the surface on which the integrated circuit is to be made, in order to produce the required circuit elements.

The photographic materials for use in the production of masks as described above should have a high resolving power and acutance and allow a correct reproduction of the dimensions of the image. Unless the dimensional reproduction is kept within the accepted tolerances the masks will be useless because it will not enable electronic components to be formed in the circuitry with the required high degree of accuracy. Developments in the field of computer and telecommunication systems create the need for ever increasing packing densities on the circuit elements and therefore it has become common practice to reproduce image details e.g. lines and slits having geometrical widths even smaller than the emulsion thickness e.g. smaller than 5 μm.

These image details should also be reproduced within the accepted width tolerances of at most 10% respective to the geometrical width of the original dimensions.

In the reproduction of very small details a number of problems are encountered e.g. image-spreading, adjacency effects, edge effects etc. which render accurate reproduction difficult so that special precautionary measures should be taken e.g. incorporation into the Lippman-emulsion light-absorbing dyes to reduce scattering of the exposure light within the emulsion layer or reflection of the exposure light at the support as described in British Pat. No. 1,298,335, and incorporating compounds reducing image distortions and promoting edge sharpness as described in the published German Patent Application Nos. (DOS) 2,161,045, 2,254,357, 2,254,358 and 2,255,032.

Even if these measures are taken the accuracy of reproduction of very small image details may remain insufficient for certain work especially when reversal processing is applied to form positive masks.

In microelectronic mask-making it is not only common practice to produce by negative processing images which are negative with respect to the original pattern but also images which are positive with respect to such original by reversal processing. Indeed, it is often difficult to position a mask produced by negative processing into register with integrated circuits, to which the images of previous masks have already been transferred, when image-details of the latter masks are smaller in size than the black image-details of the negative mask and thus are entirely hidden by the said black image-details. Proper registering can be achieved in these instances by the use of masks produced by reversal processing because the black image areas of the mask obtained on negative processing are fully transparent on reversal processing.

Reversal processing as is known in the art comprises the steps of developing the image-wise exposed emulsion to form a negative silver image, bleaching this silver image in the exposed and developed areas and then developing the remaining silver halide on the non-exposed and thus non-developed areas to produce a positive silver image, the said silver halide being made developable by fogging before or during this development e.g. by an overall re-exposure before development or by addition of a silver halide fogging agent to the developer.

Whereas for forming a negative image it suffices that a silver image of sufficient density is formed at the surface portion of the emulsion layer, the production of positive images by reversal requires that the image-wise exposure and first development are such that all silver halide in the exposed areas is developed throughout the entire emulsion thickness because no photo-sensitive silver halide should be left in the image areas after bleaching.

If any silver halide remains in the areas exposed in the first exposure step, developed silver will form in those areas by the second development step with the result that the areas of the positive image which should be clear will show undesirable fog.

In order to cause in the image-wise exposed areas the reduction of substantially all silver halide throughout the entire thickness of the emulsion, it does not suffice that the exposure intensity is high enough in order to ensure that the emulsion is affected through its full depth in exposed areas, but the first development should be such that full development of the exposed areas throughout the entire emulsion thickness is obtained. For full development the first developer in reversal processing usually comprises one or more silver halide solvents e.g. high amounts of potassium bromide and thiocyanates e.g. potassium thiocyanate to promote solution physical development.

Whereas the use of such developers with high content of silver halide solvent in the reversal processing of common silver halide materials are highly satisfactory, they do not allow correct reproduction of image details, especially details having a geometrical width of 5 μm or less when used in the reversal processing of Lippmann-emulsions. Full development of exposed Lippmann-emulsions by means of developers having high content of silver halide solvent not only promote development at the exposed areas of all silver halide throughout the entire emulsion thickness but also cause solution physical development in the adjacent non-exposed areas.

From the foregoing it is apparent that correct reproduction of image details by reversal processing of Lippmann-emulsion is more difficult to achieve than by negative processing not only because the intensity of the image-wise exposure should be higher which results in increased light-scattering and reflection, but also because the first development should be a full development using developers containing silver halide solvents causing solution physical development in adjacent non-exposed areas.

When the first development in the reversal process is a full development it is difficult to achieve accurate negative reproduction of the original image dimensions and the inevitable result of inaccuracy at that stage is inaccurate positive reproduction of the said image dimensions in the subsequent steps of reversal processing.

On the other hand if care is taken that the first development in the reversal processing is such to form a negative image of the original with sufficiently accurate reproduction of the image dimensions, it often happens that not all silver halide is developed in the exposed areas with the result that after the subsequent steps of reversal processing the positive image shows in the highlight areas undesirable fog.

The present invention basically resides in subjecting the image-wise exposed silver halide Lippmann-emulsion, in the course of reversal processing, to development under fogging conditions subsequent to development of exposed silver halide to form a negative image and prior to the usual bleaching step.

The present invention includes a method for producing high resolution reversal images by reversal processing of an exposed silver halide Lippmann-emulsion having an average grain-size of less than 100 nm comprising the steps of:

(1) developing the image-wise exposed emulsion to produce a negative silver image,
(2) bleaching the negative silver image, and
(3) developing the remaining silver halide, such remaining silver halide being made developable during or before this development step, wherein after the first development step and before the bleaching step, the emulsion is subjected to development in the presence of a silver halide fogging agent.

Due to the intermediate fogging development step according to the invention, it is not necessary for the initial image-wise exposure step and the following negative image development step in themselves to convert all silver halide to silver through the full thickness of the emulsion layer in the exposed areas. The negative image-forming steps of reversal processing can be carried out so as to obtain an accurate negative reproduction of the image dimensions and any active silver halide that remains in the exposed areas is developed to silver by the intermediate fogging development. Consequently, by means of this invention it is much easier to form positive reproductions of small image-details within acceptable tolerances without significant fog in the highlight areas.

Thus the invention includes in particular a method of forming a reversal image of an original in a silver halide Lippmann emulsion wherein the emulsion is image-wise exposed to form a latent image negative with respect to the original, and the image-wise exposed emulsion is subjected to a first stage development wherein development of exposed silver halide takes place but some silver halide is left in the exposed areas, and then to a second stage development under fogging conditions, e.g. a development in the presence of a silver halide fogging agent, to develop said residual silver halide in the exposed areas, whereafter the silver developed in said first and second development stages is bleached and the active silver halide then still remaining in the emulsion is converted to form a positive image.

In this method the image-wise exposure and the first stage development does not result in the convertion of all silver halide to silver throughout the emulsion layer thickness in the exposed areas. Consequently a negative image can be formed with high edge sharpness and without intolerable image-spreading relative to the original. In any case the first development stage is performed so that full development of silver halide in the image-wise exposed areas of the emulsion layer does not occur.

By the fogging development step any active silver halide remaining in the image-wise exposed areas is developed to silver which is then bleached in the subsequent bleaching step. The fogging development will affect silver halide in the non-exposed areas to form silver, which is bleached in the subsequent bleaching step. However, the fogging development can be performed so that sufficient silver halide remains to permit a positive silver image of the desired density to be formed.

In carrying out the present invention, the development under fogging conditions is preferably carried out so that in the non image-wise exposed areas a silver image with a density between about 0.30 and about 2.00, preferably between 0.50 and 1.20 is formed before bleaching.

The image-wise exposed silver halide emulsion is developed to provide a negative image the dimensions of which can be kept within the accepted width tolerances. Any of the common developers used for negative processing can be used for this purpose. However, it is preferred to use developing solutions producing strong Eberhard effects and having little silver halide dissolving action, by means of which small-image details, e.g. details having a geometrical width of 5 μm or less, are reproduced in the form of a negative image with high contrast gradient and edge sharpness and with dimensions relative to the dimensions of the original which are within the accepted width tolerances of at most 10%.

Particularly suitable developers for forming the negative image are developers of high pH values, preferably at least pH 11.5 and comprising hydroquinone as the sole developing agent in amounts higher than 10 g, preferably higher than 15 g per liter. The developer preferably comprises no thiocyanate or thiosulphate silver halide solvent or at most 2 g per liter, potassium bromide in amounts less than 10 g, preferably less than 5 g per liter and free sulphite ions (provided by addition to the developer of sulphites, bisulphites and/or metabisulphites) in an amount of at least 50 g per liter. These developers also comprise preferably one or more development restrainers e.g. 5-nitroindazole, 5nitrobenzimidazole or 5-nitrobenztriazole and 6-methylbenztriazole, mercapto compounds which include aliphatic, aromatic and heterocyclic mercapto compounds e.g. mercaptotetrazoles, mercaptotriazoles, mercaptothiadiazoles, mercaptooxadiazoles, mercaptothiazoles and benzthiazoles, mercaptooxazoles and benzoxazoles, mercaptopyrimidines, mercaptotriazines, etc. representatives of which are well known to those skilled in the art of silver halide photography. A preferred compound is 1-phenyl-5-mercaptotetrazole.

After the first development, the material is developed in the presence of a silver halide fogging agent so as to render silver halide remaining in the originally exposed and developed areas developable but taking care that in the non-exposed areas sufficient silver halide remains for the subsequent formation of the positive image silver.

Development in the presence of a silver halide fogging agent is well known in the art and occurs by treatment of the material with a silver halide reducing agent before, or preferably during development. Particularly suitable reducing agents are thiourea and derivatives, hydrazine and derivatives e.g. alkyl or aryl hydrazines, hydrazine carboxylic acids, acylated hydrazine, alkylsulphonamidoaryl hydrazine, naphthyl hydrazine sulphonic acids, etc. Such hydrazine derivatives have been described in U.S. Pat. Nos. 2,563,785—2,588,982—2,604,400—2,618,656—2,663,732—2,675,318—2,685,514—3,227,552 and 3,565,620 and in British Pat. No. 1,269,640. Other suitable reducing agents are tin compounds e.g. tin(II) chloride and tin complexes e.g. of the type described in British Pat. No. 1,209,050, quaternary ammonium salts, especially cyclic quaternary ammonium salts, used alone or together with hydrazine or derivatives thereof as described in U.S. Pat. No. 3,615,615 and the published German Patent Application Nos. 2,154,075 and 2,514,076.

As referred to hereinbefore fogging development preferably occurs so that before bleaching the areas, which were not image-wise exposed are developed to a density between about 0.30 and 2.00, preferably between 0.50 and 1.20.

After the fogging development the materials are bleached, and further treated by the common procedures used in reversal processing so as to develop the remaining silver halide in the originally non-exposed areas. After bleaching the elements are preferably reexposed and then developed again to form the positive image but it is also possible instead of reexposure and development to develop under fogging conditions e.g. using a silver halide reducing agent.

The materials reversal processed according to the present invention preferably comprise a Lippmann-emulsion the average silver halide grain-size of which is at most 100 nm.

Silver halide Lippmann-emulsions may be prepared according to methods well known in the art and described in the literature (see e.g. P. Glafkidès, "Photographic Chemistry", Vol. I, 1958, pages 365–368, Mees/James "The theory of the Photographic Process", 1966, p. 36 and National Physical Laboratory "Notes on Applied Science" no. 20: "Small Scale Preparation of Fine-Grain (Colloidal) Photographic emulsions", B. H. Crawford, London, 1960). They may also be prepared according to the technique described in U.S. Pat. No. 3,801,326.

Silver halide Lippmann-emulsions with very fine grain can be obtained by effecting the precipitation of the silver halide in the presence of heterocyclic mercapto compounds as described in British Pat. No. 1,204,623, heterocyclic mercapto precursor compounds as described in the published German Patent Application No. 2,161,044, compounds of the type described in U.S. Pat. Nos. 3,661,592 and 3,704,130, compounds of the type described in the February 1972 issue of "Research Disclosures", Disclosure RD 9401, Industrial Opportunities Limited, Havant, Hampshire, England.

The thickness of the emulsion layer of a photographic material used according to the present invention is preferably comprised between about 3 μm and about 8 μm, and the average grain size of the silver halide grains is preferably less than 80 nm. The ratio of silver halide to hydrophilic colloid binder is preferably at least 1:2 and at most 4:1.

Various silver salts may be used as the light-sensitive salt such as silver bromide, silver iodide, silver chloride, or mixed silver halides such as silver chlorobromide, silver bromoiodide and silver chlorobromoiodide. Silver bromide and silver bromoiodide emulsions, having a iodide content of at most 8 mole %, the average grain-size of which is at most 80 nm are favoured.

The hydrophilic colloid binder used as the vehicle for the silver halide may be any of the common hydrophilic colloids employed in photographic light-sensitive emulsions for example, gelatin, albumin, zein, casein, alginic acid, collodion, a cellulose derivative such as carboxymethyl cellulose, a synthetic hydrophilic colloid such as polyvinyl alcohol and poly-N-vinyl pyrrolidone, etc. If desired compatible mixtures of two or more colloids may be employed for dispersing the silver halide.

The light-sensitive silver halide emulsions used according to the present invention may be chemically and/or spectrally sensitized.

They may be spectrally sensitized by any of the known spectral sensitizers such as cyanines and merocyanine dyes for photographic light-sensitive silver halide materials. The silver halide emulsions according to the present invention are most advantageously sensitized for the green region of the spectrum. The exposure light is preferably chosen so that it radiates light of a wavelength to which the emulsion has been spectrally sensitized.

Particularly suitable merocyanine dyes for spectrally sensitizing the Lippmann-emulsions used according to the present invention have been described in British Pat. Nos. 654,683—904,332—1,090,626—1,298,335, in U.S. Pat. Nos. 2,526,632—3,705,038—3,753,673—3,765,900—3,765,901, in Belgian Pat. Nos. 568,840—654,816—662,796—701,921—716,831—723,720, French Pat. Nos. 942,838—994,762—1,017,981, etc.

They may be chemically sensitized by effecting the ripening in the presence of small amounts of sulphur containing compounds such as allyl thiocyanate, allyl thiourea, sodium thiosulphate, etc. The emulsions may also be sensitized by means of reductors for instance tin compounds as described in French Pat. No. 1,146,955 and in Belgian Pat. No. 568,685, imino-amino methane sulphinic acid compounds as described in British Pat. No. 789,823 and small amounts of noble metal compounds such as gold, platinum, palladium, iridium, ruthenium and rhodium. Combinations of these chemical sensitizing agents may also be used e.g. sulphur and gold sensitization and reduction and gold sensitization.

The emulsions may also comprise compounds which sensitize the emulsion by development acceleration for example compounds of the polyoxyalkylene type such as alkylene oxide condensation products as described among others in U.S. Pat. Nos. 2,531,832 and 2,533,990, in British Pat. Nos. 920,637—940,051—945,340 and 991,608 and in Belgian Pat. No. 648,710 and the known onium compounds including quaternary ammonium, quaternary phosphonium and ternary sulphonium compounds as well as onium derivatives of amino-N-oxides as described in United Kingdom Pat. No. 1,121,696.

Further the emulsion may comprise stabilizers e.g. heterocyclic nitrogen-containing thioxo compounds such as benzothiazoline-2-thione and 1-phenyl-2-tetrazoline-5-thione and compounds of the hydroxytriazolopyrimidine type. They can also be stabilized with mercury compounds such as the mercury compounds described in Belgian Pat. Nos. 524,121 and 677,337, British Pat. No. 1,173,609 and in U.S. Pat. No. 3,179,520.

The emulsion may further comprise compounds which reduce image distortions and prompte edge sharpness e.g. of the type described in the published German Patent Application Nos. 2,161,045—2,254,357—2,254,358 and 2,255,032.

Any of the hardening agents for hydrophilic colloids may be used in the emulsions according to the present invention such as chromium, aluminum and zirconium salts, formaldehyde, dialdehydes, hydroxyaldehydes, acrolein, glyoxal, halogen substituted aldehyde acids such as mucochloric acid and mucobromic acid, diketones such as divinyl ketone, compounds carrying one or more vinylsulphonyl groups such as divinylsulphone, 1,3,5-trivinylsulphonylbenzene, hexahydro-s-triazines carrying vinylcarbonyl, halogenacetyl and/or acyl groups such as 1,3,5-triacryloylhexahydro-1,3,5-triazine, 1,3-diacryloyl-5-acetyl-hexahydro-1,3,5-triazine, 1,3,5-trichloroacetyl-hexahydro-1,3,5-triazine, etc.

The emulsions may also comprise light-absorbing dyes which are so chosen that they absorb light of the wavelength to which the material is exposed so that scattering and reflection of light within the photographic material is reduced. For more details regarding these dyes there can be referred to Belgian Pat. No. 699,375 and the patent literature referred to therein, and to U.S. Pat. No. 3,652,280. The dyes are preferably used in such amounts that per micron of emulsion layer thickness a density comprised between 0.05 and 0.20, measured in the spectral region of the exposure light, is obtained.

It may further be advantageous to provide between the support and the emulsion layer an antihalation coating as described in the May 1974 issue of "Research Disclosure", Disclosure RD 12 106, Industrial Opportunities Limited, Havant, Hampshire, England.

The emulsions may be coated on a wide variety of photographic emulsion supports. Typical supports include cellulose ester film, polyvinyl acetal film, polystyrene film, polyethylene terephthalate film and related films of resinous materials as well as paper and glass. In the manufacture of high resolution plate materials for the preparation of masks for use in the electronic industry, glass supports are most advantageously used in view of their high dimensional stability.

In order to promote adhesion of the emulsion layer to glass supports in the preparation of high resolution plate materials, the silicon compounds described in British Pat. No. 1,286,467 can be incorporated into the emulsion.

The light-sensitive emulsions may also comprise all other kinds of ingredients such as plasticizers, coating aids, etc.

Though the invention has been particularly described in view of the preparation of masks as used in the production of microelectronic integrated circuits, the same favourable effects are obtained by reversal processing according to the invention of Lippmann-materials used for other purposes where accurate reproduction of very small image details is of primary importance.

The following example illustrates the present invention:

EXAMPLE

A series of photographic high resolution plates were used each comprising coated on a glass support a silver bromoiodide Lippmann-emulsion having an average grain diameter of 50 nm and containing a spectral sensitizer for the green region of the spectrum as well as a light-screening dye in an amount corresponding to a density (measured in the green spectral region) of 0.07 per μm of layer thickness.

After contact exposure of the plates through a chromium mask using a band filter with band width of 52 nm and peak transmission at 525 mm the plates were processed according to one of the following procedures.

(1) Negative processing:

—development for 6 min at 20° C. in a developer of the composition:

| | |
|---|---|
| hydroquinone | 16.5 g |
| potassium bromide | 1,7 g |
| sodium salt of EDTA | 40 g |
| 1-phenyl-5-mercapto-tetrazole | 35 g |
| sodium hydroxide and water to make | 1 liter with pH 11.8 |

—fixing and washing as conventional.

Lines having a width of 3 μm were reproduced with a line-broadening of only 0.2 μm. The fog was 0.04.

(2) Reversal processing:

—development for 6 min at 20° C. in a developer of the composition:

| | |
|---|---|
| hydroquinone | 25 g |
| potassium bromide | 2.5 g |
| sodium salt of EDTA | 2.5 g |
| potassium metabisulphite | 62.5 g |
| 1-phenyl-5-mercaptotetrazole | 50 mg |
| potassium thiocyanate | 0.5 g |
| sodium hydroxide and water to make | 1 liter at pH 11.8 |

—bleaching for 5 min at 20° C. in a bleach of the composition:

| | |
|---|---|
| potassium dichromate | 5 g |
| strong sulphuric acid (d) 1.85) | 10 ml |
| water to make | 1 liter |

—rinsing for a few minutes followed by clearing for 5 min at 20° C. in a bath comprising 100 g of sodium sulphite per liter.

—rinsing for a few minutes followed by overall re-exposure and development for 6 min at 20° C. in a developer of the composition given for the above negative processing.

After a final rinse and drying the slits of 3 μm width were reproduced with only 0.2 μm line broadening but they showed a fog value of 0.25. Maximum density is above 5.00.

(3) Reversal processing with intermediate fogging development:

Plates were reversal processed as described above with the difference that the first development step was followed by treatment for 30 seconds at 20° C. in a developer of the composition described above for negative processing, to which 100 mg of thiourea had been added per liter as fogging agent, and which was then diluted to 2.66 or 5.3 times its volume.

The results obtained were as follows:

| dilution | fog | line broadening Δ μm | $D_{max}$ |
|---|---|---|---|
| 2.66 x | 0.06 | 0.3 | 4.36 |

-continued

| dilution | fog | line broadening Δ μm | $D_{max}$ |
|---|---|---|---|
| 5.3 x | 0.09 | 0.3 | 4.60 |

The above results show that by the fogging development the fog in the highlight areas of the reversal processed Lippmann-plate is reduced with maintenance of line broadening within tolerable values.

After the treatment with the fogging developer (2.66 times diluted) a density of about 0.95 was developed in the areas that were not exposed by the image-wise exposure.

We claim:

1. A method of forming a reversal image of an original in a silver halide Lippmann-emulsion, the average silver halide grain size of which is less than 100 nm, wherein the emulsion is image-wise exposed and subjected to a first stage development so that a negative silver image of the original is formed but some silver halide is left in the exposed areas, and then to a second stage development under fogging conditions to develop said residual silver halide in the exposed areas, whereafter the silver developed in said first and second development stages is bleached and the active silver halide then still remaining in the emulsion is converted to form a positive image.

2. Method of producing a reversal image according to claim 1, comprising the steps of (1) developing the image-wise exposed emulsion to produce a negative silver image, (2) further developing the emulsion under fogging conditions, (3) bleaching the developed silver, and (4) developing the remaining silver halide, such remaining silver halide being made developable during or before this development.

3. Method according to claim 1, wherein after the development under fogging conditions and before bleaching a density comprised between about 0.30 and about 2.00 is formed in the non image-wise exposed areas.

4. Method according to claim 1, wherein the development under fogging conditions occurs by treatment with a silver halide developer comprising a silver halide reducing agent.

5. Method according to claim 4, wherein the reducing agent is thiourea.

6. Method according to claim 1, wherein the first development to form a negative image is a development by means of a developing composition the pH of which is at least 11.5 comprising hydroquinone as the sole developing agent in an amount of at least 10 g per liter, a thiocyanate or thiosulphate silver halide solvent in an amount of from 0 to 2 g per liter, potassium bromide in an amount of at most 10 g per liter and free sulphite ions in an amount of at least 50 g per liter.

7. Method according to claim 6, wherein the first developer also comprises a development restraining compound.

8. Method according to claim 7, wherein the development restraining compound is 1-phenyl-5-mercapto-tetrazole.

9. Method according to claim 1, wherein the bleaching step is followed by overall-re-exposure and then development of the exposed silver halide.

10. Method according to claim 1, wherein the silver halide Lippmann-emulsion is a silver bromide emulsion or a silver bromoiodide emulsion with a iodide content of at most 8 mole %.

* * * * *